US009206587B2

(12) United States Patent
Linstroth et al.

(10) Patent No.: US 9,206,587 B2
(45) Date of Patent: Dec. 8, 2015

(54) AUTOMATED CONTROL OF DIPPER SWING FOR A SHOVEL

(71) Applicant: Harnischfeger Technologies, Inc., Wilmington, DE (US)

(72) Inventors: Michael Linstroth, Port Washington, WI (US); Joseph Colwell, Hubertus, WI (US); Mark Emerson, Germantown, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 113 days.

(21) Appl. No.: 13/843,532

(22) Filed: Mar. 15, 2013

(65) Prior Publication Data

US 2013/0245897 A1 Sep. 19, 2013

Related U.S. Application Data

(60) Provisional application No. 61/611,682, filed on Mar. 16, 2012.

(51) Int. Cl.

| | |
|---|---|
| ***E02F 9/20*** | (2006.01) |
| ***E02F 9/24*** | (2006.01) |
| ***E02F 3/43*** | (2006.01) |
| ***E02F 3/30*** | (2006.01) |
| ***E02F 9/26*** | (2006.01) |

(52) U.S. Cl.

CPC ..... *E02F 9/2025* (2013.01); *E02F 3/30* (2013.01); *E02F 3/435* (2013.01); *E02F 9/24* (2013.01); *E02F 9/265* (2013.01)

(58) Field of Classification Search

None

See application file for complete search history.

(56) References Cited

U.S. PATENT DOCUMENTS

| | | | |
|---|---|---|---|
| 3,207,339 | A | 9/1965 | Neslin |
| 3,642,159 | A | 2/1972 | Askins |

(Continued)

FOREIGN PATENT DOCUMENTS

| | | |
|---|---|---|
| DE | 19856610 | 6/1999 |
| EP | 0003287 A1 | 8/1979 |

(Continued)

OTHER PUBLICATIONS

International Search Report and Written Opinion for Application No. PCT/US2013/032769 dated May 31, 2013 (20 pages).

(Continued)

*Primary Examiner* — Rami Khatib
*Assistant Examiner* — Jeffrey Boomer
(74) *Attorney, Agent, or Firm* — Michael Best & Friedrich LLP

(57) ABSTRACT

Systems and methods for compensating dipper swing control. One method includes, with at least one processor, determining a direction of compensation opposite a current swing direction of the dipper and applying the maximum available swing torque in the direction of compensation when an acceleration of the dipper is greater than a predetermined acceleration value. The method can also include determining a current state of the shovel and performing the above steps when the current state of the shovel is a swing-to-truck state or a return-to-tuck state. When the current state of the shovel is a dig-state, the method can include limiting the maximum available swing torque and allowing, with the at least one processor, swing torque to ramp up to the maximum available swing torque over a predetermined period of time when dipper is retracted to a predetermined crowd position.

16 Claims, 16 Drawing Sheets

(56) References Cited

U.S. PATENT DOCUMENTS

| | | | | |
|---|---|---|---|---|
| 3,648,029 | A | 3/1972 | Ungnadner | |
| 4,104,518 | A | 8/1978 | Schachinger et al. | |
| 4,398,851 | A | 8/1983 | Geuns et al. | |
| 5,404,661 | A | 4/1995 | Sahm et al. | |
| 5,442,868 | A | 8/1995 | Ahn | |
| 5,493,798 | A | 2/1996 | Rocke et al. | |
| 5,528,498 | A | 6/1996 | Scholl | |
| 5,548,516 | A | 8/1996 | Gudat et al. | |
| 5,717,628 | A | 2/1998 | Hammerl et al. | |
| 5,748,097 | A | 5/1998 | Collins | |
| 5,908,458 | A | 6/1999 | Rowe et al. | |
| 5,937,292 | A | 8/1999 | Hammerl et al. | |
| 5,953,977 | A | 9/1999 | Krishna et al. | |
| 5,968,103 | A * | 10/1999 | Rocke | 701/50 |
| 5,978,504 | A | 11/1999 | Leger | |
| 6,025,686 | A | 2/2000 | Wickert et al. | |
| 6,058,344 | A | 5/2000 | Rowe et al. | |
| 6,072,127 | A * | 6/2000 | Oslakovic | 177/136 |
| 6,076,030 | A | 6/2000 | Rowe | |
| 6,085,583 | A | 7/2000 | Cannon et al. | |
| 6,108,949 | A | 8/2000 | Singh et al. | |
| 6,167,336 | A | 12/2000 | Singh et al. | |
| 6,223,110 | B1 | 4/2001 | Rowe et al. | |
| 6,225,574 | B1 | 5/2001 | Chang et al. | |
| 6,247,538 | B1 | 6/2001 | Takeda et al. | |
| 6,272,413 | B1 | 8/2001 | Takahashi et al. | |
| 6,317,669 | B1 | 11/2001 | Kurenuma et al. | |
| 6,336,077 | B1 | 1/2002 | Boucher | |
| 6,363,173 | B1 | 3/2002 | Stentz et al. | |
| 6,363,632 | B1 | 4/2002 | Stentz et al. | |
| 6,466,850 | B1 | 10/2002 | Hilgart | |
| 6,732,458 | B2 | 5/2004 | Kurenuma et al. | |
| 6,885,930 | B2 | 4/2005 | Wang | |
| 7,034,476 | B2 | 4/2006 | Wang et al. | |
| 7,126,299 | B2 | 10/2006 | Jackson | |
| 7,181,370 | B2 | 2/2007 | Furem et al. | |
| 7,227,273 | B2 | 6/2007 | Ahmad et al. | |
| 7,307,399 | B2 | 12/2007 | Furem | |
| 7,308,352 | B2 | 12/2007 | Wang et al. | |
| 7,375,490 | B2 | 5/2008 | Furem | |
| 7,385,372 | B2 | 6/2008 | Ahmad et al. | |
| 7,398,012 | B2 | 7/2008 | Koellner | |
| 7,406,399 | B2 | 7/2008 | Furem et al. | |
| 7,479,757 | B2 | 1/2009 | Ahamd | |
| 7,574,821 | B2 | 8/2009 | Furem | |
| 7,578,079 | B2 | 8/2009 | Furem | |
| 7,622,884 | B2 | 11/2009 | Furem | |
| 7,726,048 | B2 | 6/2010 | Stanek et al. | |
| 7,751,927 | B2 | 7/2010 | Pulli et al. | |
| 7,752,779 | B2 | 7/2010 | Schoenmaker et al. | |
| 7,832,126 | B2 | 11/2010 | Koellner et al. | |
| 7,979,182 | B2 | 7/2011 | Ooki et al. | |
| 2007/0240341 | A1 | 10/2007 | Hyde | |
| 2008/0201108 | A1 | 8/2008 | Furem et al. | |
| 2008/0212344 | A1 | 9/2008 | Furem | |
| 2008/0282583 | A1 * | 11/2008 | Koellner et al. | 37/348 |
| 2009/0055056 | A1 * | 2/2009 | Ooki et al. | 701/50 |
| 2009/0229101 | A1 | 9/2009 | Ahmad et al. | |
| 2009/0272109 | A1 * | 11/2009 | Pfaff | 60/368 |
| 2010/0010714 | A1 | 1/2010 | Claxton | |
| 2010/0036645 | A1 | 2/2010 | McAree | |
| 2010/0076612 | A1 | 3/2010 | Robertson | |
| 2010/0109417 | A1 * | 5/2010 | Jackson et al. | 299/1.4 |
| 2010/0185416 | A1 | 7/2010 | Furem et al. | |
| 2010/0223008 | A1 | 9/2010 | Dunbabin et al. | |
| 2010/0283675 | A1 * | 11/2010 | McAree et al. | 342/357.28 |
| 2011/0029206 | A1 * | 2/2011 | Kang et al. | 701/50 |
| 2011/0073392 | A1 * | 3/2011 | Collins et al. | 180/65.22 |
| 2011/0106384 | A1 | 5/2011 | Corke et al. | |
| 2011/0197680 | A1 * | 8/2011 | Shackelford, IV | 73/650 |
| 2011/0301817 | A1 | 12/2011 | Hobenshield et al. | |
| 2011/0313608 | A1 * | 12/2011 | Izumi et al. | 701/22 |
| 2011/0314802 | A1 * | 12/2011 | Lastre et al. | 60/436 |
| 2012/0101693 | A1 | 4/2012 | Taylor | |
| 2012/0263566 | A1 | 10/2012 | Taylor et al. | |
| 2012/0277961 | A1 | 11/2012 | Colwell et al. | |
| 2012/0283919 | A1 * | 11/2012 | Kuras et al. | 701/50 |
| 2013/0051963 | A1 | 2/2013 | Taylor | |
| 2013/0066527 | A1 | 3/2013 | Mizuochi et al. | |
| 2013/0096782 | A1 | 4/2013 | Good et al. | |
| 2013/0298544 | A1 * | 11/2013 | Izumi et al. | 60/413 |
| 2013/0311054 | A1 * | 11/2013 | Choi | 701/50 |
| 2013/0325269 | A1 * | 12/2013 | Izumi et al. | 701/50 |
| 2014/0032059 | A1 * | 1/2014 | Udagawa et al. | 701/50 |
| 2014/0084831 | A1 * | 3/2014 | Kawaguchi et al. | 318/434 |

FOREIGN PATENT DOCUMENTS

| | | | |
|---|---|---|---|
| EP | 0003287 | B1 | 3/1981 |
| EP | 0036384 | A2 | 9/1981 |
| EP | 0036384 | A3 | 3/1982 |
| EP | 0053270 | A1 | 6/1982 |
| EP | 0053270 | B1 | 7/1984 |
| EP | 0114024 | A1 | 7/1984 |
| EP | 0036384 | B1 | 11/1984 |
| EP | 0114024 | B1 | 3/1987 |
| EP | 0402517 | A1 | 12/1990 |
| EP | 0412395 | A1 | 2/1991 |
| EP | 0412398 | A1 | 2/1991 |
| EP | 0412399 | A1 | 2/1991 |
| EP | 0412400 | A1 | 2/1991 |
| EP | 0412402 | A1 | 2/1991 |
| EP | 0414926 | A1 | 3/1991 |
| EP | 0428778 | A1 | 5/1991 |
| EP | 0428783 | A1 | 5/1991 |
| EP | 0442344 | A2 | 8/1991 |
| EP | 0442344 | A3 | 4/1992 |
| EP | 0412402 | B1 | 4/1993 |
| EP | 0535765 | A2 | 4/1993 |
| EP | 0402518 | B1 | 9/1993 |
| EP | 0412399 | B1 | 1/1994 |
| EP | 0428783 | B1 | 1/1994 |
| EP | 0402517 | B1 | 3/1994 |
| EP | 0412400 | B1 | 3/1994 |
| EP | 0414926 | B1 | 3/1994 |
| EP | 0412395 | B1 | 9/1994 |
| EP | 0412398 | B1 | 9/1994 |
| EP | 0442344 | B1 | 1/1995 |
| EP | 0907805 | B1 | 1/2001 |
| EP | 0912806 | B1 | 9/2001 |
| JP | 2000192514 | | 7/2000 |
| WO | 9746763 | A1 | 12/1997 |
| WO | 9746767 | A1 | 12/1997 |
| WO | 9847793 | A1 | 10/1998 |
| WO | 9902788 | A1 | 1/1999 |
| WO | 0004240 | A1 | 1/2000 |
| WO | 0140824 | | 6/2001 |
| WO | 2005012028 | A1 | 2/2005 |
| WO | 2005118329 | A1 | 12/2005 |
| WO | 2006028938 | A1 | 3/2006 |
| WO | 2007057305 | | 5/2007 |
| WO | 2008144043 | A2 | 11/2008 |
| WO | 2008144043 | A3 | 2/2009 |
| WO | 2009024405 | | 2/2009 |
| WO | 2009131635 | A2 | 10/2009 |
| WO | 2009131635 | A3 | 12/2009 |
| WO | 2010033959 | A1 | 3/2010 |
| WO | 2010132065 | A1 | 11/2010 |

OTHER PUBLICATIONS

P&H, P&H Update on C-Series Shovels and Centurion Technology, WMEA Tucson 2007, (20 pages).

P&H, Centurion Shovel Control System, Driving the Ultimate Digging Machine, 2009, (6 pages).

Winstanley, Graeme et al., Dragline Automation—A Decade of Development, IEEE Robotics & Automation Magazine, Sep. 2007, p. 52-64.

4170C Service Manual—Section 17 Crawler Maintenance, p. 127, 2012.

(56) References Cited

OTHER PUBLICATIONS

Autonomous Loading Application, Carnegie Mellon University Roboticts Institute, national Robotics Engineering Center, Retrieved from Internet on Dec. 28, 2010 <URL:http://www.rec.ri.cmu.edu/projects/als/application/>.

* cited by examiner

Option #1

Option #2

Option #2

Option #3

Option #4

Option #5

Option #6

Subroutine #1A

Subroutine #1B

Subroutine #1C

Subroutine #2A

Subroutine #2B

Subroutine #2C

AUTOMATED CONTROL OF DIPPER SWING FOR A SHOVEL

RELATED APPLICATIONS

The present application claims priority to U.S. Provisional Patent Application No. 61/611,682, filed Mar. 16, 2012, the entire content of which is incorporated herein by reference.

BACKGROUND

This invention relates to monitoring performance of an industrial machine, such as an electric rope or power shovel, and automatically adjusting the performance.

SUMMARY

Industrial machines, such as electric rope or power shovels, draglines, etc., are used to execute digging operations to remove material from, for example, a bank of a mine. An operator controls a rope shovel during a dig operation to load a dipper with materials. The operator deposits the materials in the dipper into a hopper or a truck. After unloading the materials, the dig cycle continues and the operator swings the dipper back to the bank to perform additional digging. Some operators improperly swing the dipper into the bank at a high rate of speed, which, although slows and stops the dipper for a dig operation, can damage the dipper and other components of the shovel, such as the racks, handles, saddle blocks, shipper shaft, and boom. The dipper can also impact other objects during a dig cycle (e.g., the hopper or truck, the bank, other pieces of machinery located around the shovel, etc.), which can damage the dipper or other components.

Accordingly, embodiments of the invention automatically control the swing of the dipper to reduce impact and stresses caused by impacts of the dipper with objects located around the shovel, such as the bank, the ground, and the hopper. For example, a controller monitors operation of the dipper after the dipper has been unloaded and is returned to the bank for a subsequent dig operation. The controller monitors various aspects of the dipper swing, such as speed, acceleration, and reference indicated by the operator controls (e.g., direction and force applied to operator controls, such as a joystick). The controller uses the monitored information to determine if the dipper is swinging too fast where the dipper will impact the bank at an unreasonable speed. In this situation, the controller uses motor torque to slow the swing of the dipper when it detects high impact with the bank. In particular, the controller applies motor torque in the opposite direction of the movement of the dipper, which counteracts the speed of the dipper and decelerates the swing speed.

In particular, one embodiment of the invention provides a method of compensating swing of a dipper of a shovel. The method includes determining, by at least one processor, a direction of compensation opposite a current swing direction of the dipper, and applying, by the at least one processor, the maximum available swing torque in the direction of compensation opposite the current swing direction of the dipper when an acceleration of the dipper is greater than a predetermined acceleration value.

Another embodiment of the invention provides a system for compensating swing of a dipper of a shovel. The system includes a controller including at least one processor. The at least one processor is configured to limit the maximum available swing torque, determine a crowd position of the dipper, and restrict the swing torque ramp up to the limited maximum available swing torque over a predetermined period of time after the dipper reaches a predetermined crowd position.

Other aspects of the invention will become apparent by consideration of the detailed description and accompanying drawings.

DETAILED DESCRIPTION

Figure 1:
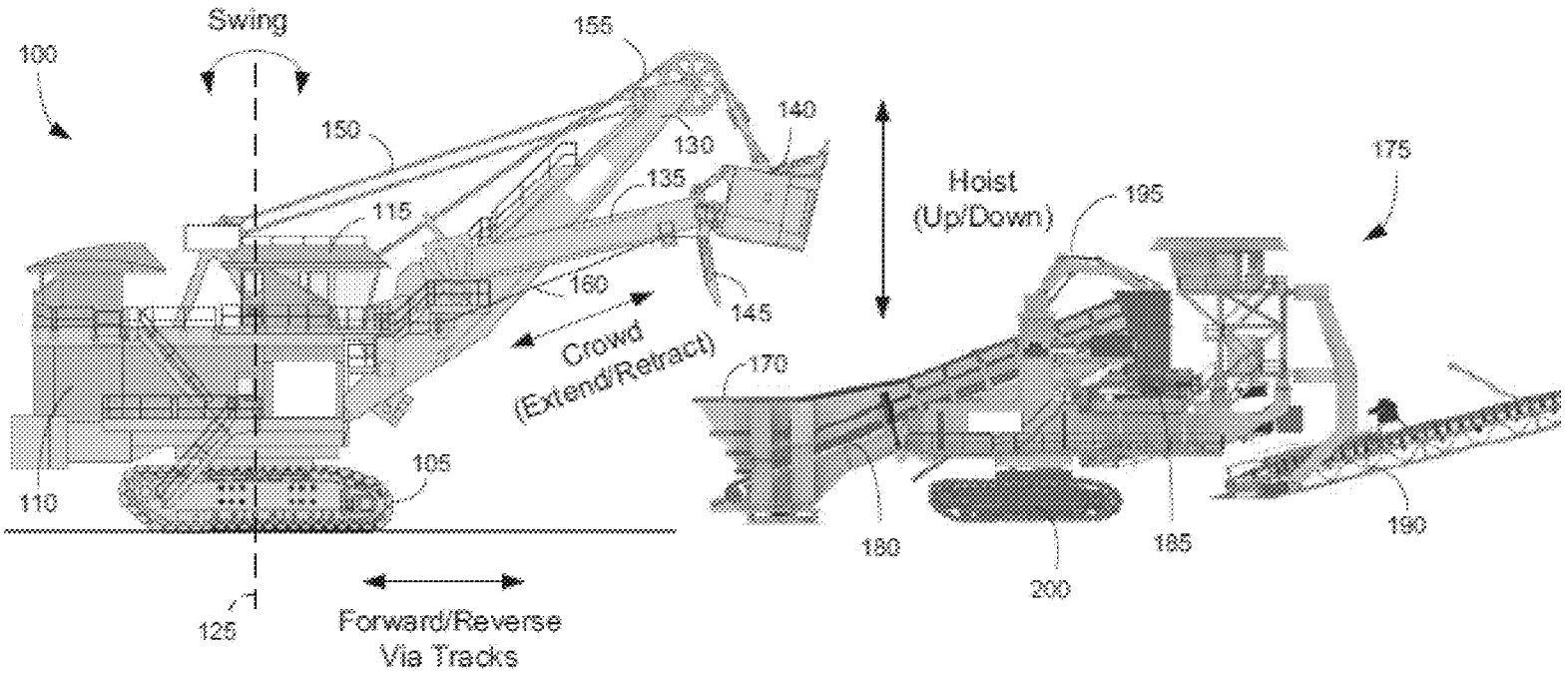
FIG. 1 illustrates an industrial machine according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible. For example, "controllers" described in the specification can include standard processing components, such as one or more processors, one or more computer-readable medium modules, one or more input/output interfaces, and various connections (e.g., a system bus) connecting the components.

FIG. 1 depicts an exemplary rope shovel 100. The rope shovel 100 includes tracks 105 for propelling the rope shovel 100 forward and backward, and for turning the rope shovel 100 (i.e., by varying the speed and/or direction of the left and right tracks relative to each other). The tracks 105 support a base 110 including a cab 115. The base 110 is able to swing or swivel about a swing axis 125, for instance, to move from a digging location to a dumping location and back to a digging location. In some embodiments, movement of the tracks 105 is not necessary for the swing motion. The rope shovel further includes a dipper shaft or boom 130 supporting a pivotable dipper handle 135 and a dipper 140. The dipper 140 includes a door 145 for dumping contents contained within the dipper 140 into a dump location.

The shovel 100 also includes taut suspension cables 150 coupled between the base 110 and boom 130 for supporting the boom 130; a hoist cable 155 attached to a winch (not shown) within the base 110 for winding the cable 155 to raise and lower the dipper 140; and a dipper door cable 160 attached to another winch (not shown) for opening the door 145 of the dipper 140. In some instances, the shovel 100 is a P&H® 4100 series shovel produced by Joy Global, although the shovel 100 can be another type or model of mining excavator.

When the tracks 105 of the mining shovel 100 are static, the dipper 140 is operable to move based on three control actions, hoist, crowd, and swing. Hoist control raises and lowers the dipper 140 by winding and unwinding the hoist cable 155. Crowd control extends and retracts the position of the handle 135 and dipper 140. In one embodiment, the handle 135 and dipper 140 are crowded by using a rack and pinion system. In another embodiment, the handle 135 and dipper 140 are crowded using a hydraulic drive system. The swing control swivels the dipper 140 relative to the swing axis 125. During operation, an operator controls the dipper 140 to dig earthen material from a dig location, swing the dipper 140 to a dump location, release the door 145 to dump the earthen material, and tuck the dipper 140, which causes the door 145 to close, while swinging the dipper 140 to the same or another dig location.

FIG. 1 also depicts a mobile mining crusher 175. During operation, the rope shovel 100 dumps materials from the dipper 140 into a hopper 170 of the mining crusher 175 by opening the door 145. Although the rope shovel 100 is described as being used with the mobile mining crusher 175, the rope shovel 100 is also able to dump materials from the dipper 140 into other material collectors, such as a dump truck (not shown) or directly onto the ground.

Figure 2A:
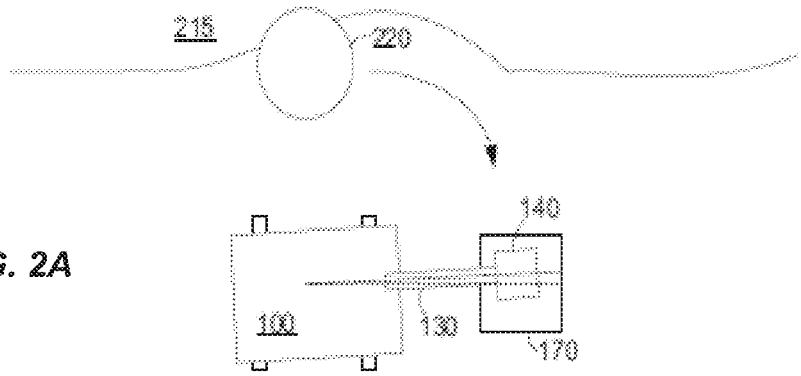
FIGS. 2A and 2B illustrate a swing of the machine of FIG. 1 between a dig location and a dumping location.

FIG. 2A depicts the rope shovel 100 positioned in a dumping position. In the dumping position, the boom 130 is positioned over the hopper 170 and the door 145 is opened to dump the materials contained within the dipper 140 into the hopper 170.

Figure 2B:
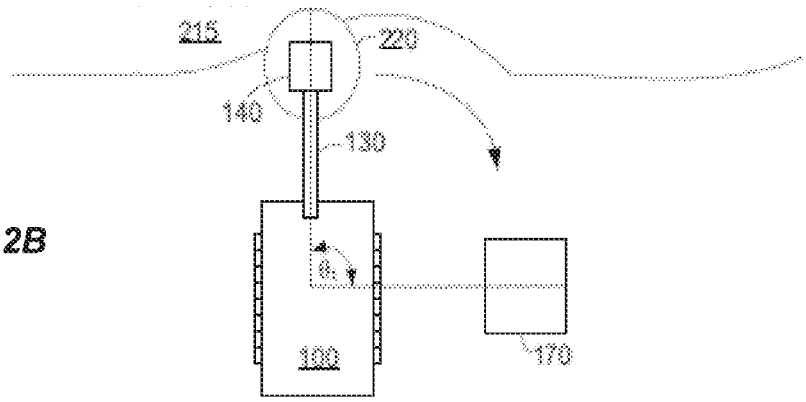

FIG. 2B depicts the rope shovel 100 positioned in a digging position. In the digging position, the boom 130 digs with the dipper 140 into a bank 215 at a dig location 220. After digging, the rope shovel 100 is returned to the dumping position and the process is repeated as needed.

As described above in the summary section, when the shovel 100 swings the dipper 140 back to the digging position, the bank 215 should not be used to decelerate and stop the dipper 140. Therefore, the shovel 100 includes a controller that may compensate control of the dipper 140 to ensure the dipper 140 swings at a proper speed and is decelerated as it nears the bank 215 or other objects. The controller can include combinations of hardware and software operable to, among other things, monitor operation of the shovel 100 and compensate control the dipper 140 if applicable.

Figure 3:
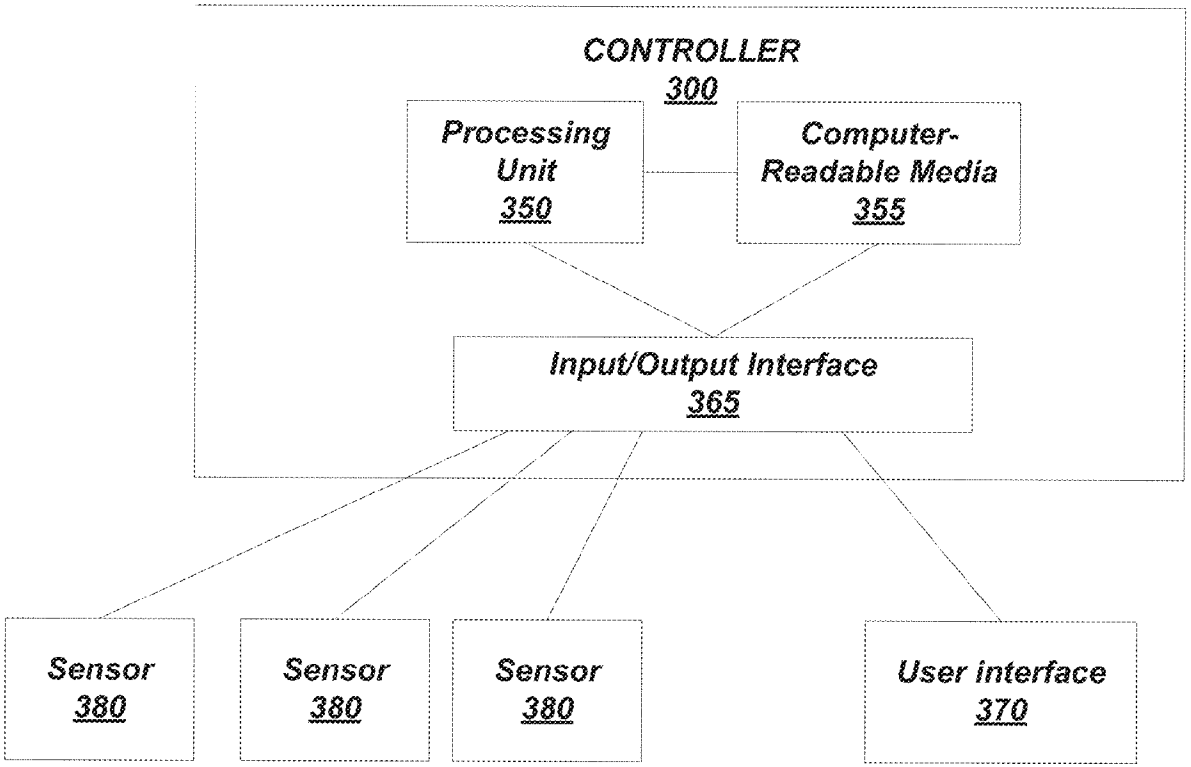
FIG. 3 illustrates a controller for an industrial machine according to an embodiment of the invention.

A controller 300 according to one embodiment of the invention is illustrated in FIG. 3. As illustrated in FIG. 3, the controller 300 includes, among other things, a processing unit 350 (e.g., a microprocessor, a microcontroller, or another suitable programmable device), non-transitory transitory computer-readable media 355, and an input/output interface 365. The processing unit 350, the media 355, and the input/output interface 365 are connected by one or more control and/or data buses. It should be understood that in other constructions, the controller 300 includes additional, fewer, or different components.

The computer-readable media 355 stores program instructions and data, and the controller 300 is configured to retrieve from the media 355 and execute, among other things, the instructions to perform the control processes and methods described herein. The input/output interface 365 exchanges data between the controller 300 and external systems, networks, and/or devices and receives data from external systems, networks, and/or devices. The input/output interface 365 can store data received from external sources to the media 355 and/or provides the data to the processing unit 350.

As illustrated in FIG. 3, the controller 300 receives input from an operator interface 370. The operator interface 370 includes a crowd control, a swing control, a hoist control, and a door control. The crowd control, swing control, hoist control, and door control include, for instance, operator-controlled input devices, such as joysticks, levers, foot pedals, and other actuators. The operator interface 370 receives operator input via the input devices and outputs digital motion commands to the controller 300. The motion commands include, for example, hoist up, hoist down, crowd extend, crowd retract, swing clockwise, swing counterclockwise, dipper door release, left track forward, left track reverse, right track forward, and right track reverse. Upon receiving a motion command, the controller 300 generally controls the one or more motors or mechanisms (e.g., a crowd motor, swing motor, hoist motor, and/or a shovel door latch) as commanded by the operator. As will be explained in greater detail, however, the controller 300 is configured to compensate or modify the operator motion commands and, in some embodiments, generate motion commands independent of the operator commands. In some embodiments, the controller 300 also provides feedback to the operator through the operator interface 370. For example, if the controller 300 is modifying operator commands to limit operation of the dipper 140, the controller 300 can interact with the user interface module 370 to notify the operator of the automated control (e.g., using visual, audible, and/or haptic feedback).

The controller 300 is also in communication with a plurality of sensors 380 to monitor the location, movement, and status of the dipper 140. The plurality of sensors 380 can include one or more crowd sensors, swing sensors, hoist sensors, and/or shovel sensors. The crowd sensors indicate a level of extension or retraction of the dipper 140. The swing sensors indicate a swing angle of the handle 135. The hoist sensors indicate a height of the dipper 140 based on the hoist cable 155 position. The shovel sensors 380 indicate whether the dipper door 145 is open (for dumping) or closed. The shovel sensors 380 may also include one or more weight sensors, acceleration sensors, and/or inclination sensors to provide additional information to the controller 300 about the load within the dipper 140. In some embodiments, one or more of the crowd sensors, swing sensors, and hoist sensors include resolvers or tachometers that indicate an absolute position or relative movement of the motors used to move the dipper 140 (e.g., a crowd motor, a swing motor, and/or a hoist motor). For instance, as the hoist motor rotates to wind the hoist cable 155 to raise the dipper 140, the hoist sensors output a digital signal indicating an amount of rotation of the hoist and a direction of movement to indicate relative movement of the dipper 140. The controller 300 translates these outputs into a position (e.g., height), speed, and/or acceleration of the dipper 140.

As noted above, the controller 300 is configured to retrieve instructions from the media 355 and execute the instruction to perform various control methods relating to the shovel 100. For example, FIGS. 4-9 illustrate methods performed by the controller 300 based on instructions executed by the processor 350 to monitor dipper swing performance and adjust or compensate dipper performance based on real-world feedback. Accordingly, the proposed methods help mitigate stresses applied to the shovel 100 from swing impacts in various shovel cycle states. For example, the controller 300 can compensate dipper control while the dipper 140 is digging in the bank 215, swinging to the mobile crusher 175, or freely-swinging.

The methods illustrated in FIGS. 4-9 represent multiple variations or options for implementing such an automated control method for dipper swing. It should be understood that additional options are also possible. In particular, as illustrated in FIGS. 4-9, some of the proposed methods incorporate subroutines that also have multiple options or variations for implementing. For example, various acceleration monitoring implementations can be combined with different shovel states, such as dig, swing-to-dump (e.g., swing-to-truck), etc. In addition, rather than explain every permutation of a control method and a subroutine, the subroutines are referenced in the methods illustrated in FIGS. 4-9 but are described separately in FIGS. 10*a*-10*c* and 11*a*-11*c*. In particular, the points of intersection of the subroutines with the control methods illustrated in FIGS. 4-9 are marked using a dashed line (e.g., ····· ). In addition, some of the differences from one iteration to the next are marked using a dot-and-dashed line (e.g., —··—··· ).

Figure 4:
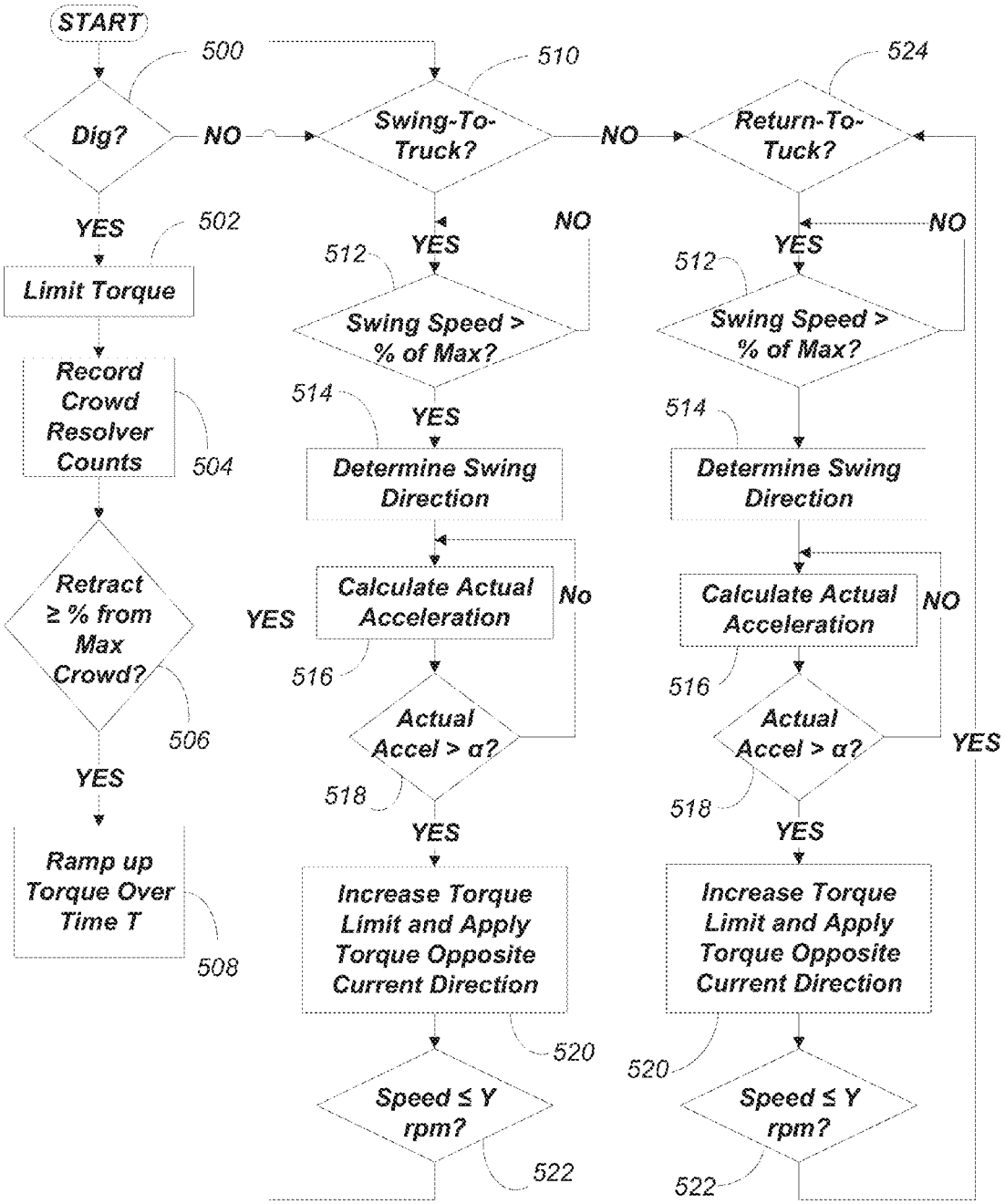
FIGS. 4-9 are flow charts illustrating methods for automatically controlling a swing of a dipper of the machine of FIG. 1

FIG. 4 illustrates an Option #1 for compensating dipper swing control. As illustrated in FIG. 4, when the shovel 100 is in the dig mode or state (at 500), the controller 300 can optionally limit the maximum available swing torque of the dipper 140 to a predetermined percentage of the maximum available torque (e.g., approximately 30% to approximately 80% of the maximum available swing torque) (at 502). The controller 300 also monitors the crowd resolver counts to determine a maximum crowd position (at 504). After determining a maximum crowd position, the controller 300 determines when the operator has retracted the dipper 140 a predetermined percentage (e.g., approximately 5% to approximately 40%) from the maximum crowd position (at 506). When this occurs, the controller 300 allows the swing torque to ramp up to the maximum available torque over a predetermined time period T (at 508). In some embodiments, the predetermined time period is between approximately 100 milliseconds and 2 seconds (e.g., approximately 1.0 second).

As shown in FIG. 4, when the shovel 100 is in a swing-to-truck state (at 510), the controller 300 optionally determines if the swing speed of the dipper 140 is greater than a predetermined percentage of the maximum speed (e.g., approximately 5% to approximately 40% of the maximum speed) (at 512). In some embodiments, until the swing speed reaches this threshold, the controller 300 does not compensate the control of the dipper 140. The controller 300 also determines a swing direction of the dipper 140 (at 514). The controller 300 uses the determined swing direction to identify a direction of compensation (i.e., a direction opposite the current swing direction to counteract and slow a current swing speed).

The controller 300 then calculates actual swing acceleration (at 516). If the value of the actual acceleration (e.g., the value of a negative acceleration) is greater than a predetermined value a (e.g., indicating that the dipper 140 struck an object) (at 518), the controller 300 compensates swing control of the dipper 140. In particular, the controller 300 can increase the maximum available swing torque (e.g., up to approximately 200%) and apply the increased available torque (e.g., 100% of the increased torque) in the compensation direction (at 520). It should be understood that in some embodiments, the controller 300 applies the maximum available torque limit without initially increasing the limit. After the swing speed drops to or below a predetermined value Y (e.g., approximately 0 rpm to approximately 300 rpm) (at 522), the controller 300 stops swing compensation and the dipper 140 returns to its default or normal control (e.g., operator control of the dipper 140 is not compensated by the controller 300).

In the return-to-tuck state of Option #1 (at 524), the controller 300 performs a similar function as the swing-to-truck state of Option #1. However, the predetermined value a that the controller 300 compares the current swing acceleration (at 518) against is adjusted to account for the dipper 140 being empty rather than full as during the swing-to-truck state.

Figure 5A:
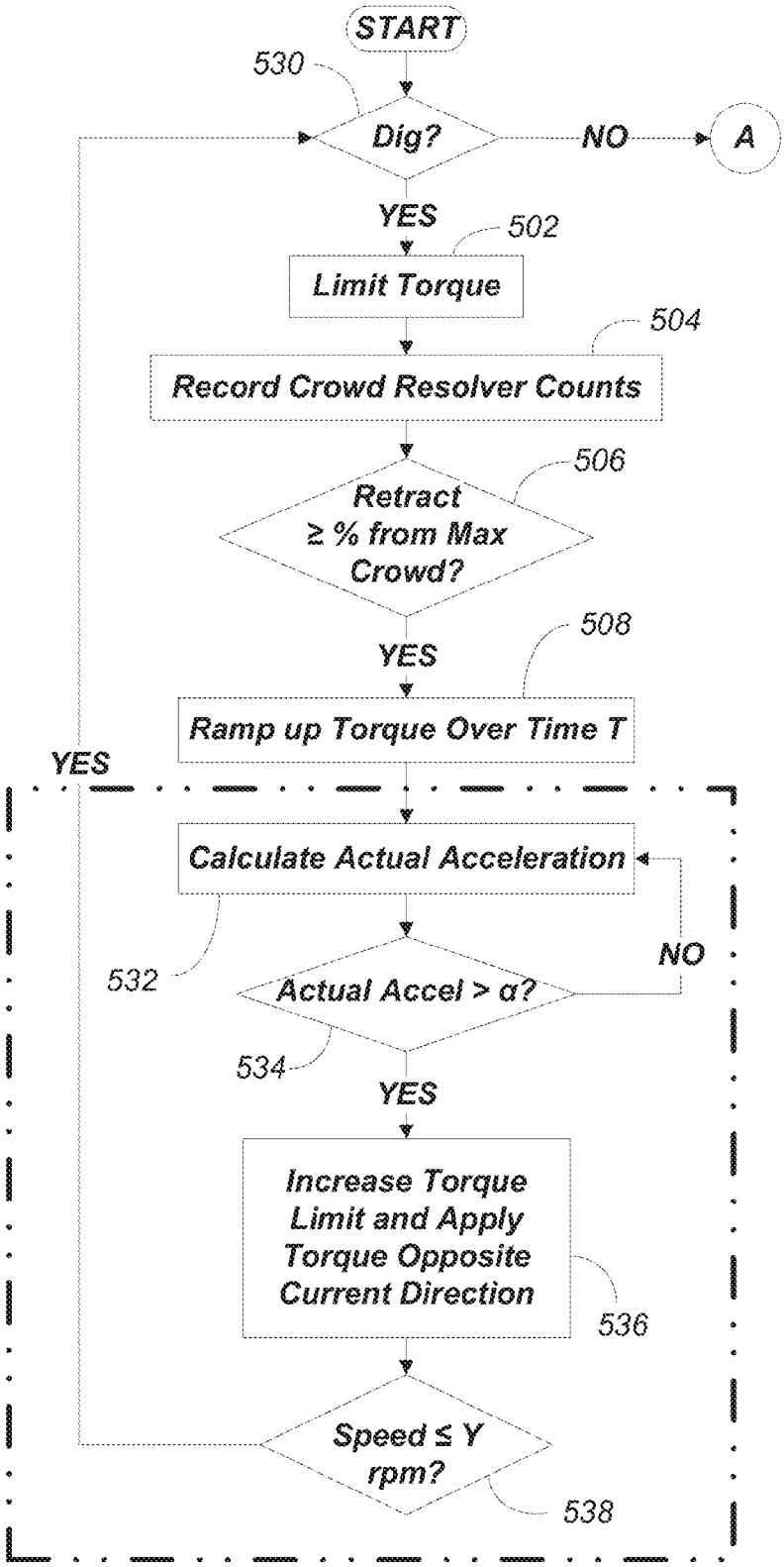
Figure 5B:
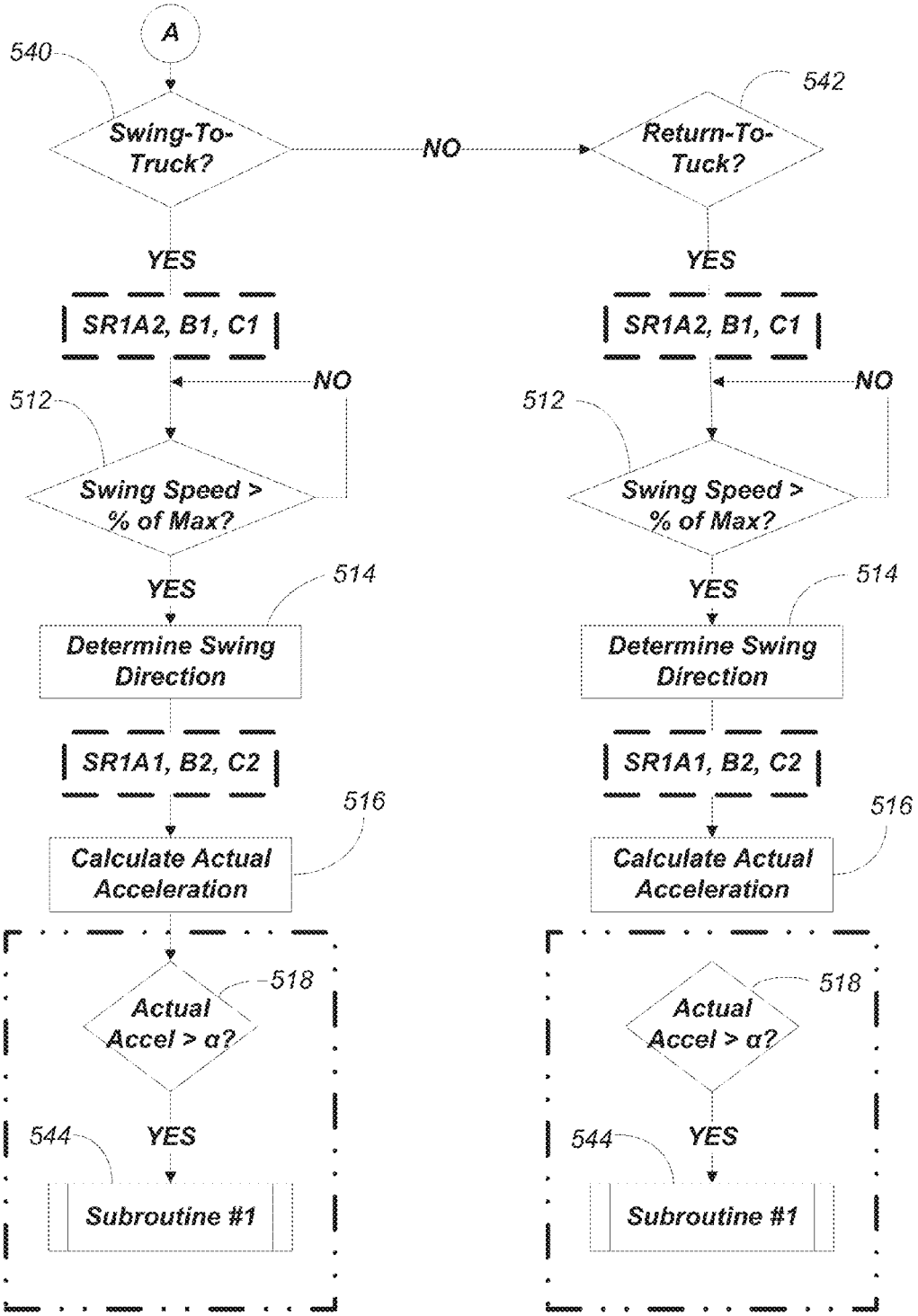

FIGS. 5*a* and 5*b* illustrates an Option #2 for compensating dipper swing control. As illustrated in FIG. 5*a*, when the shovel 100 is in the dig state (at 530), the controller 300 operates similar to Option #1 described above for the dig state. In particular, the controller 300 operates similar to Option #1 through allowing the swing torque to ramp up to the maximum available torque over a predetermined time period T (at 508) after the dipper 140 has been retracted to a predetermined crowd position (at 506). Once this occurs, in Option #2, the controller 300 calculates actual swing acceleration (e.g., a negative acceleration) of the dipper 140 (at 532). If the value of the actual acceleration is greater than a predetermined value a (at 534) (e.g., indicating that the dipper 140 struck an object), the controller 300 starts swing compensation. In particular, the controller 300 can increase the available maximum swing torque (e.g., up to approximately 200%) and apply the increased torque (e.g., 100% of the torque) in the compensation direction (at 536). It should be understood that in some embodiments, the controller 300 applies the maximum available torque limit without initially increasing the limit. When the swing speed drops to or below a predetermined speed Y (e.g., approximately 0 rpm to approximately 300 rpm) (at 538), swing control returns to standard swing control (e.g., operator control as compared to compensated control through the controller 300).

As shown in FIG. 5*b*, when the shovel 100 is in the swing-to-truck state (at 540) or the return-to-tuck state (at 542), the controller 300 operates as described above for Option #1 through the calculation of current acceleration (at 516) and comparing the calculated acceleration to a predetermined value a (at 518). At this point, the controller 300 activates Subroutine #1 (at 544), which results in three possible responses. Subroutine #1 is described below with respect to FIGS. 10*a*-10*c*.

Figure 6:
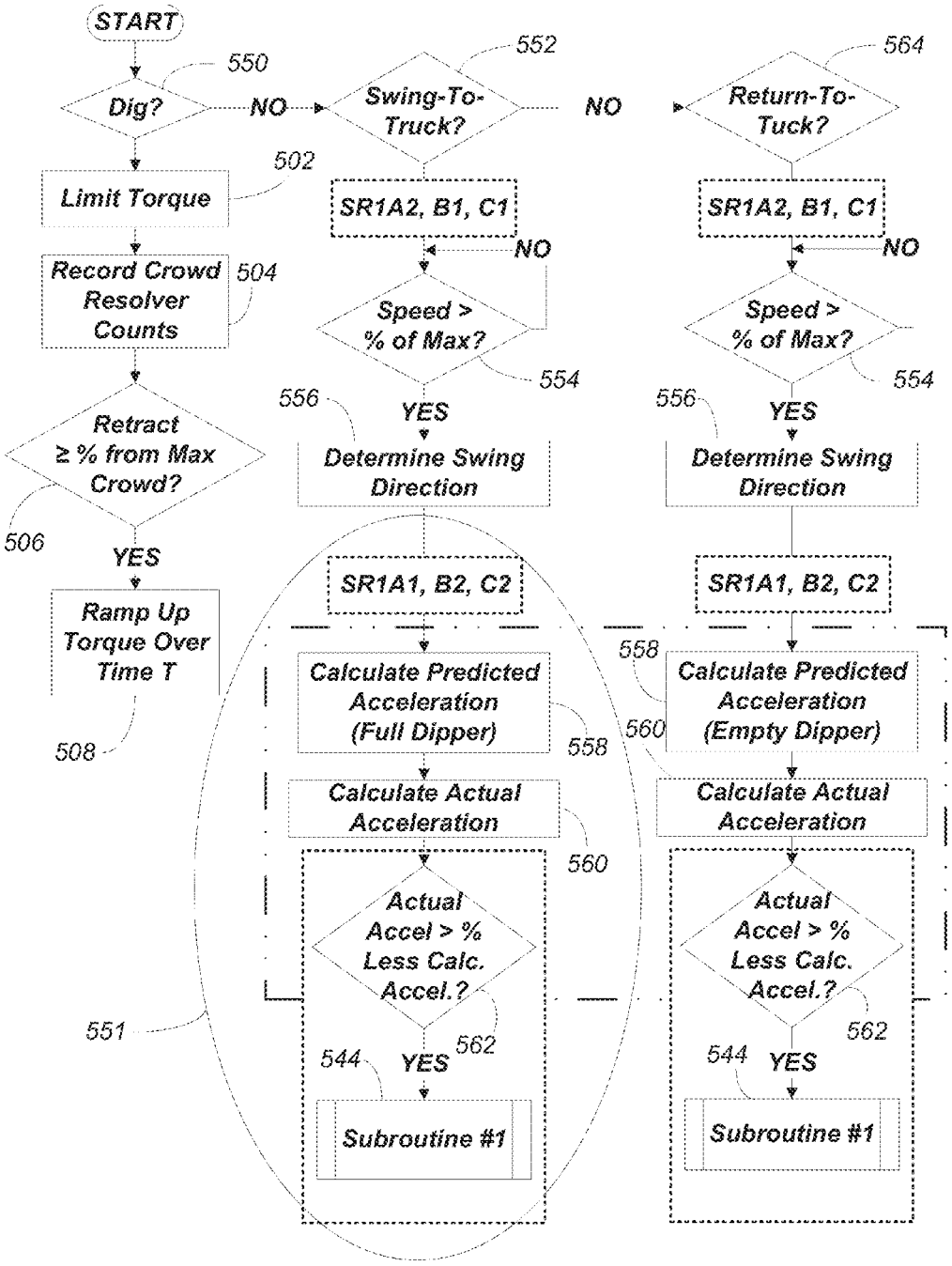

FIG. 6 illustrates an Option #3 for compensating dipper swing control. As illustrated in FIG. 6, when the shovel 100 is in the dig state (at 550), the controller 300 operates as described above with respect to the dig state in Option #1. Also, it should be understood that in some embodiments, the controller 300 replaces ramping up swing torque (at 508) with monitoring acceleration as described below for the swing-to-truck state of Option #3 (see section 551 in FIG. 6).

As illustrated in FIG. 6, in the swing-to-truck state (at 552), the controller 300 optionally determines if the swing speed of the dipper 140 is greater than a predetermined percentage (e.g., approximately 5% to approximately 40%) of the maximum speed (at 554). In some embodiments, if the speed is less than this threshold, the controller 300 does not take any correction action. The controller 300 also determines a swing direction to determine a compensation direction opposite the swing direction (at 556). The controller 300 then calculates a predicted swing acceleration based on a torque reference (i.e., how far the operator moves the input device, such as a joystick controlling the dipper swing) and an assumption that the dipper 140 is full (at 558). In some embodiments, there are two options for calculating this value. In one option, the controller 300 assumes the dipper 140 is in a standard position with vertical ropes. In another option, the controller 300 uses the dipper position (e.g., radius, height, etc.) and resulting inertia to calculate the predicted acceleration. Generally, the greater the torque reference, the greater the predicted acceleration.

After calculating the predicted acceleration (at 558), the controller 300 calculates the actual swing acceleration of the dipper 140 (e.g., a negative acceleration) (at 560). If the value of the actual acceleration is more than a predetermined percentage less than the predicted acceleration (e.g., more than approximately 10% to approximately 30% less than the predicted acceleration, which indicates that the dipper 140 struck an object) (at 562), the controller 300 starts swing control compensation. In particular, to compare the calculated predicted acceleration and the actual acceleration, the controller 300 activates Subroutine #1 (at 544), which, as noted above, results in one of three possible responses (see FIGS. 10*a*-10*c*).

As shown in FIG. 6, in the return-to-tuck state (at 564), the controller 300 operates as described above for the swing-to-truck state of Option #3. However, the controller calculates the predicted acceleration assuming that the dipper 140 is empty rather than full (at 558). As noted above, in some embodiments, there are two options for calculating this acceleration value. In one option, the controller 300 assumes the dipper 140 is in a standard position with vertical ropes. In another option, the controller 300 uses the dipper position (e.g., radius, height, etc.) and resulting inertia to calculate the predicted acceleration.

Figure 7:
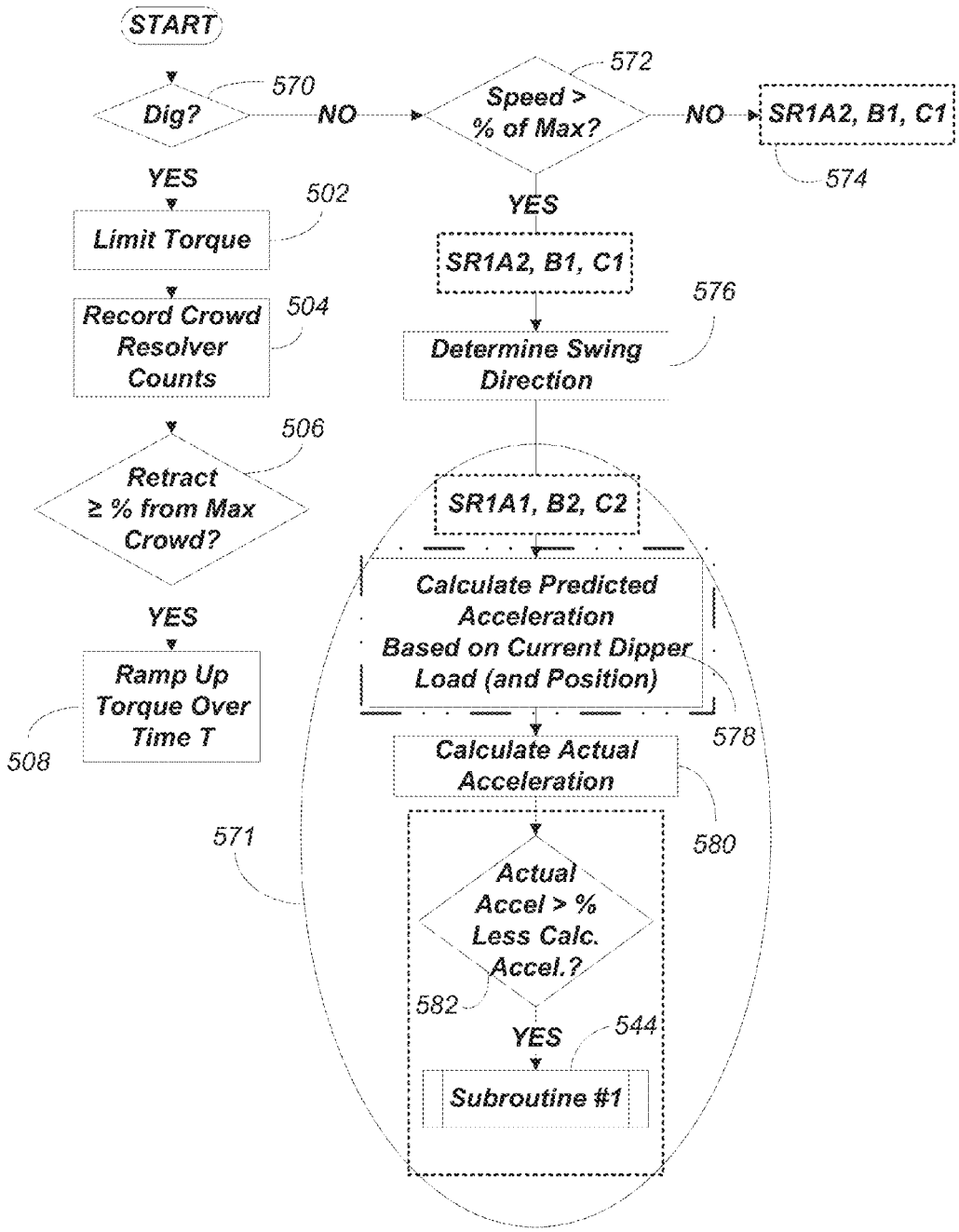

FIG. 7 illustrates an Option #4 for compensating dipper swing control. As illustrated in FIG. 7, when the shovel 100 is in the dig state (at 570), the controller 300 operates similar to Option #1. Also, it should be understood that, in some embodiments, the controller 300 replaces ramping up swing torque (at 508) with monitoring acceleration as described below for the other states of Option #4 (see section 571 in FIG. 7).

As illustrated in FIG. 7, when the shovel 100 is in any state over than the dig state (at 570), the controller 300 determines if the current swing speed is greater than a predetermined percentage of the maximum swing speed (e.g., approximately 5% to approximately 40% of the maximum swing speed) (at 572). If the swing speed is not greater than this threshold, the controller 300 activates Subroutine #2 (at 574), which results in one of three possible responses. See FIGS. 11*a*-11*c* for details regarding Subroutine #2.

If the swing speed is greater than the threshold (at 572), the controller determines a current swing direction to determine a compensation direction (at 576). The controller 300 then calculates a predicted swing acceleration based on a swing torque reference, a current dipper payload, and, optionally, a dipper position (at 578). In some embodiments, there are two options for calculating the predicted acceleration. In one option, the controller 300 assumes the dipper 140 is in a standard position with vertical ropes. In another option, the controller 300 calculates the predicted acceleration based dipper position (e.g., radius, height, etc.) and resulting inertia of the dipper 140.

After calculating the predicted acceleration (at 578), the controller 300 calculates an actual swing acceleration (e.g., a negative acceleration) (at 580) and determines if the value of the actual acceleration is more than a predetermined percentage less than the predicted acceleration (e.g., more than approximately 10% to approximately 30% less than the predicted acceleration, which indicates that the dipper 140 struck an object) (at 582). If so, the controller 300 activates Subroutine #1 (at 544). See FIGS. 10*a*-10*c* for details regarding Subroutine #1.

Figure 8:
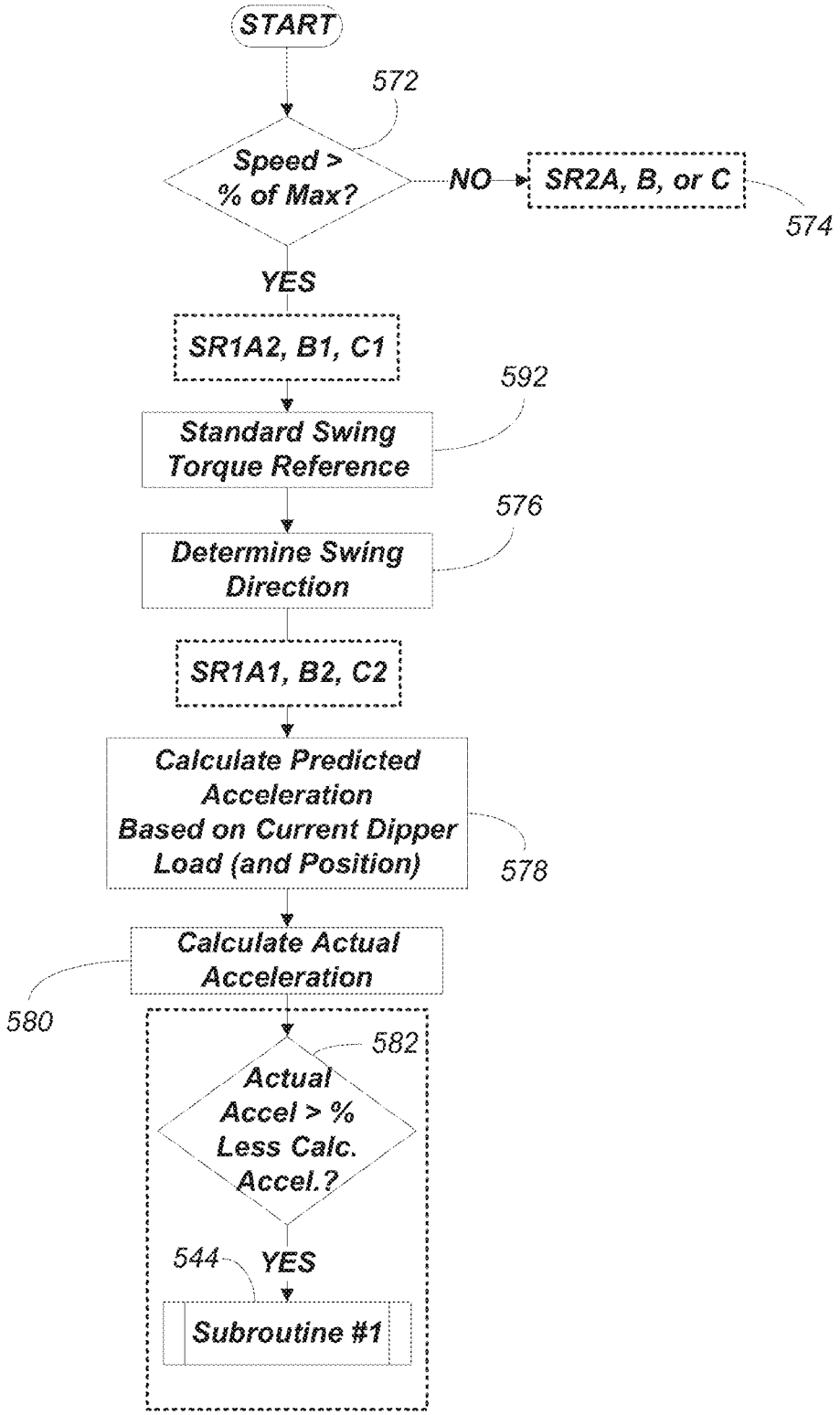

FIG. 8 illustrates an Option #5 for compensating dipper swing control. As illustrated in FIG. 8, regardless of the current state of the shovel 100, the controller 300 determines if the current swing speed of the dipper 140 is greater than a predetermined percentage of the maximum swing speed (e.g., approximately 5% to approximately 40%) (at 572). If the current speed is not greater than this threshold, the controller 300 activates Subroutine #2 (at 574), which results in one of three possible responses (see FIGS. 11*a*-11*c*). Alternatively, when the current speed is greater than the threshold, the controller 300 determines a current swing direction to determine a compensation direction (at 576). The controller 300 also calculates a predicted swing acceleration based on a torque reference, a current dipper payload, and, optionally, a dipper position (at 578). In some embodiments, the controller 300 can use one of multiple options for calculating the predicted acceleration. In one option, the controller assumes that the dipper 140 is in a standard position with vertical ropes. In another option, the controller 300 uses dipper position (e.g., radius, height, etc.) and resulting inertia to calculate the predicted acceleration. After calculating the predicted acceleration, the controller 300 calculates an actual acceleration (e.g., a negative acceleration) (at 580) and determines if the value of the actual acceleration is more than a predetermined percentage less than the predicted acceleration (e.g., more than approximately 10% to approximately 30% less than the predicted acceleration, which indicates that the dipper 140 struck an object) (at 582) (see Subroutine #1).

Figure 9:
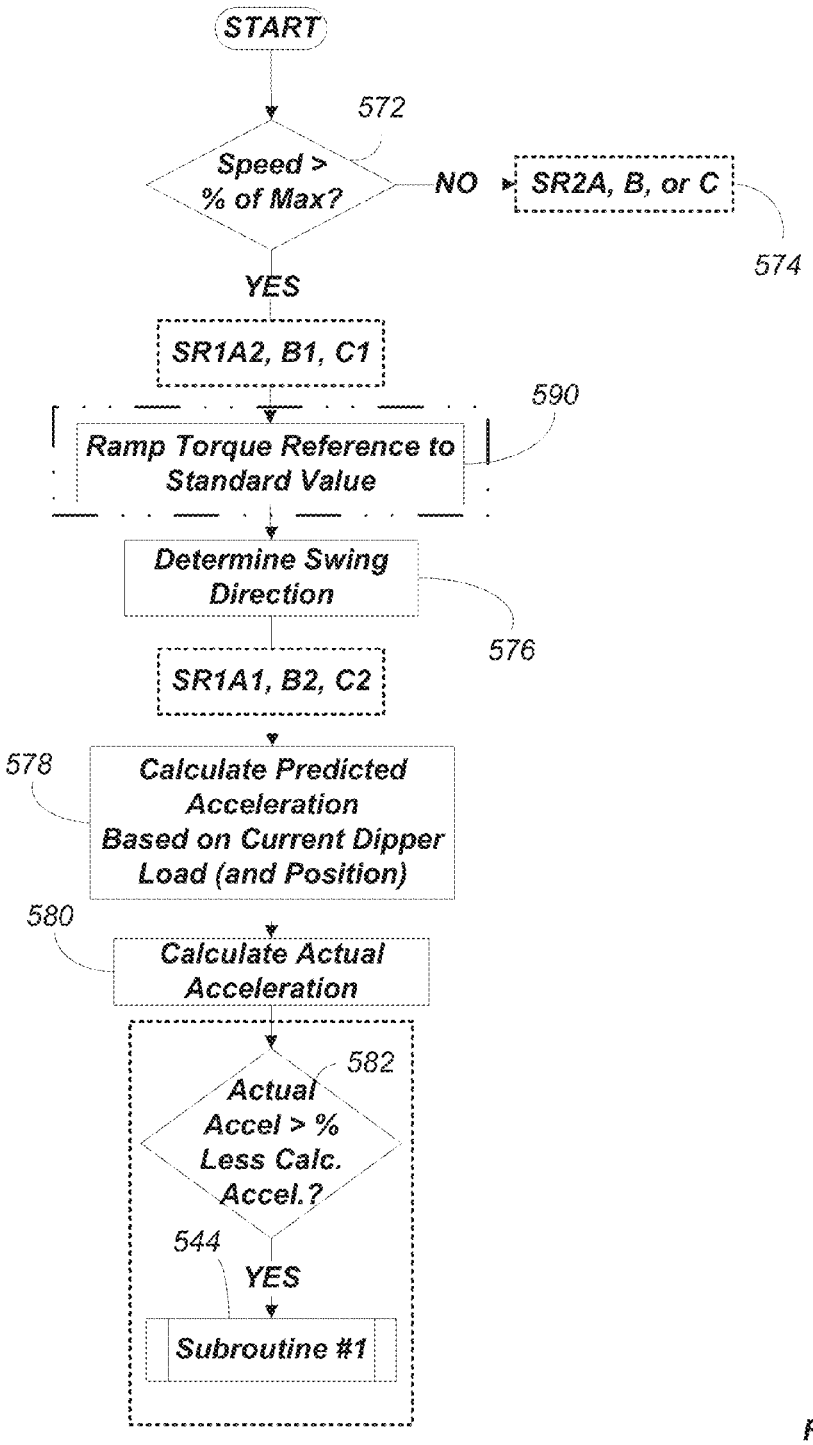

FIG. 9 illustrates an Option #6 for compensating dipper swing control. As illustrated in FIG. 9, Option #6 is similar to Option #5 except that when the swing speed is greater than the predetermined percentage of the maximum swing speed (at 572), the torque level is ramped up (at 590) rather than immediately stepped to the maximum (at 592, FIG. 8).

Figure 10A:
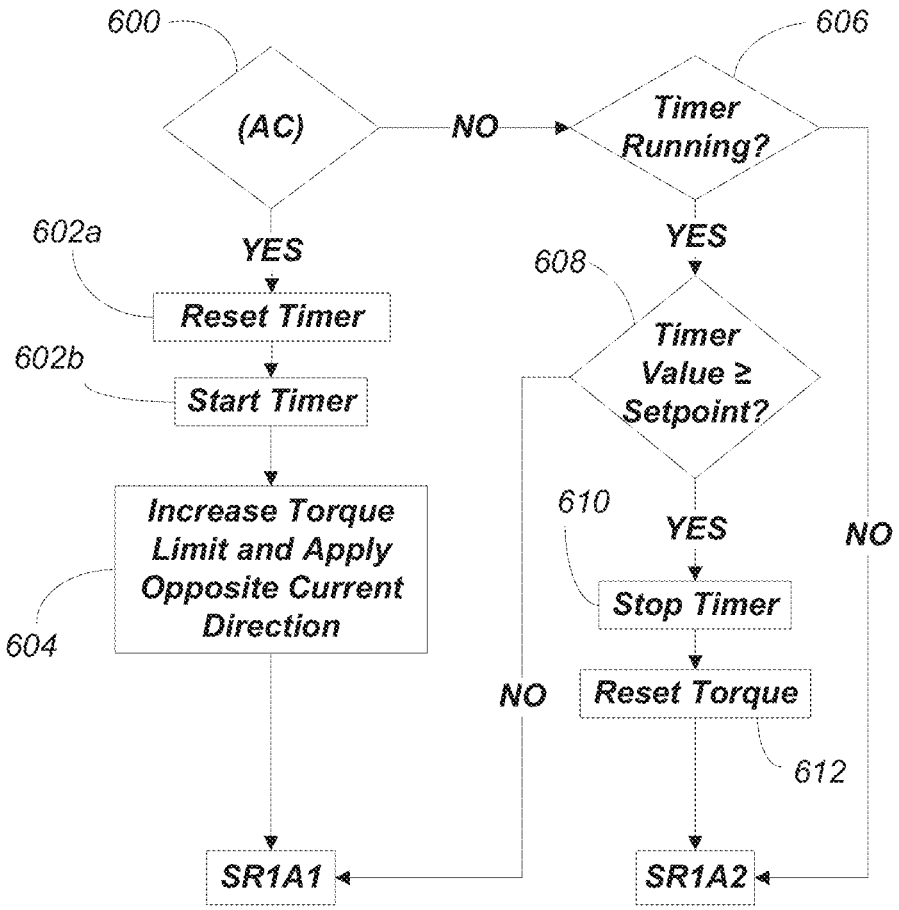
FIGS. 10*a*-10*c* and 11*a*-11*c* are flow charts illustrating subroutines activated within at least some of the methods of FIGS. 4-9.
Figure 10B:
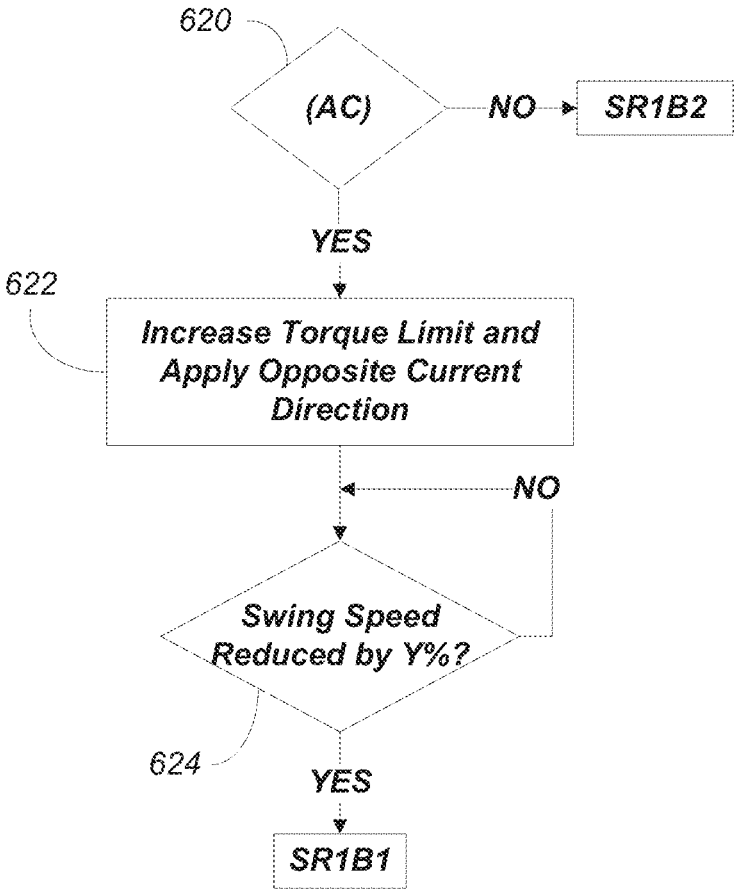
Figure 10C:
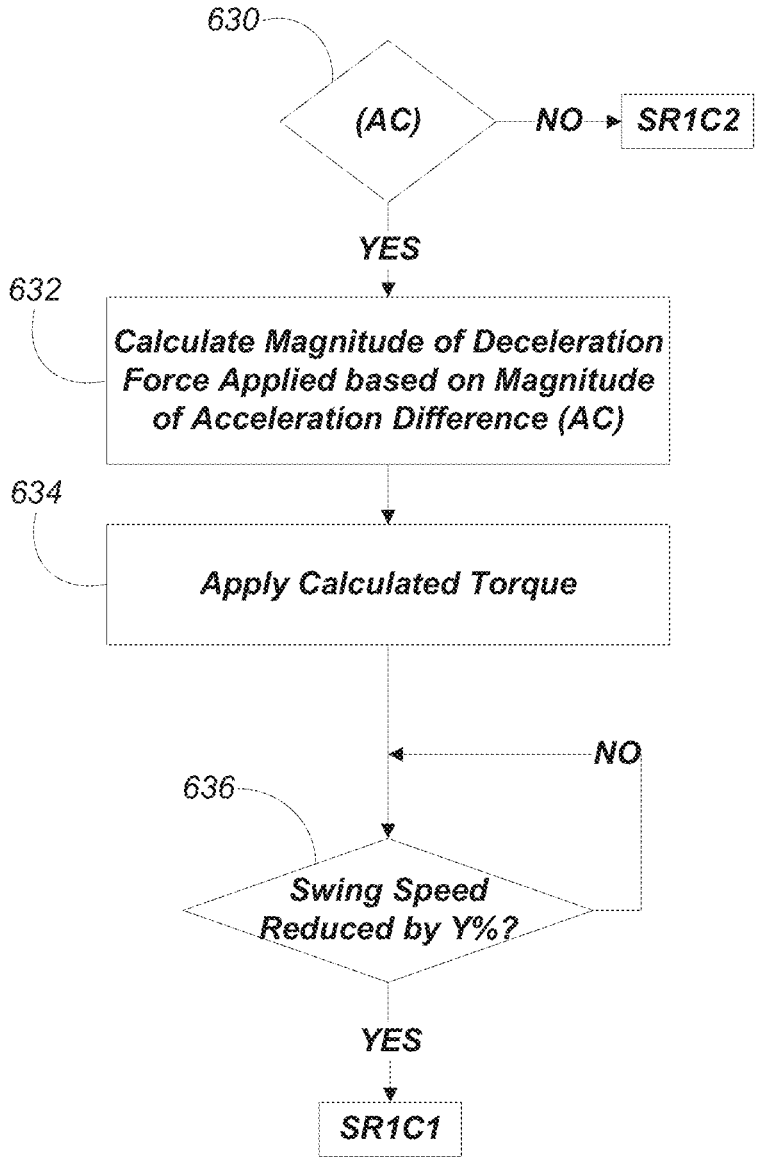
Figure 12:
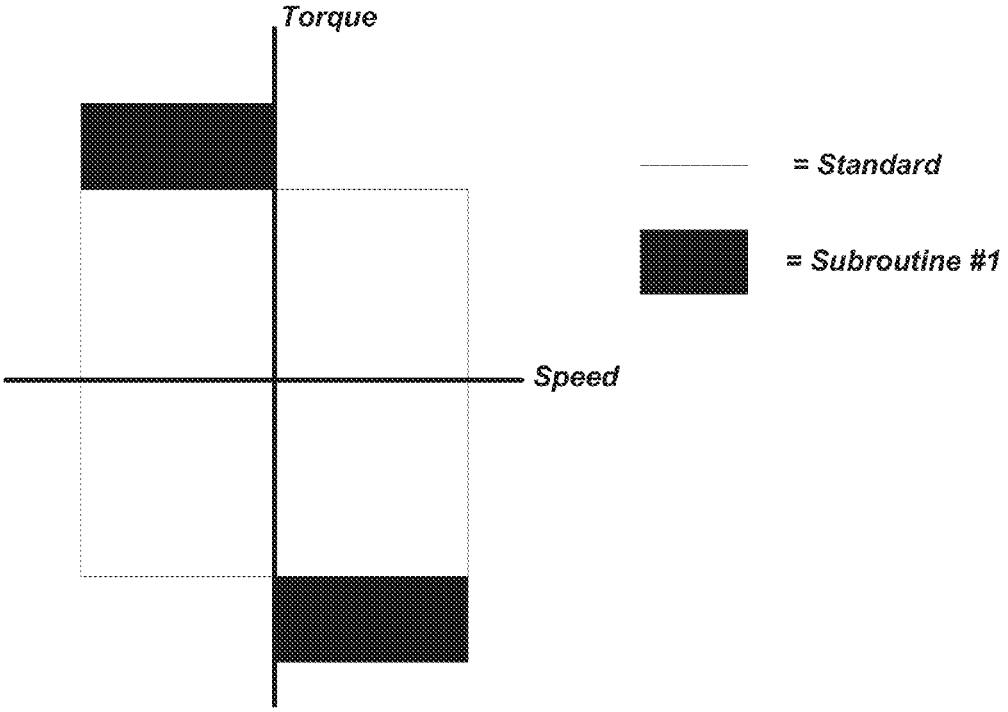
FIGS. 12-13 are graphical representations of the resulting torque-speed curves for the subroutines of FIGS. 10*a*-10*c* and 11*a*-11*c*.

FIGS. 10*a*-10*c* illustrate Subroutine #1. Subroutine #1 provides three possible routines associated with comparing predicted swing acceleration and actual acceleration (the comparison referred to as "AC" in FIGS. 10*a*-10*c*). The possible routines are defined as Subroutines 1A, 2A, and 3A. A representation of the resulting torque-speed curve for Subroutine #1 is shown in FIG. 12. As illustrated in FIG. 12, during execution of Subroutine #1, additional torque is made available.

As illustrated in FIG. 10*a*, in Subroutine 1A, when the value of the actual acceleration is more than a predetermined percentage less than the predicted acceleration (at 600), the controller 300 starts or resets a timer (at 602*a* or 602*b*). The controller 300 then increases the available torque limit (e.g., sets the torque to greater than 100% of the current reference torque) and applies approximately 100% of the reference torque in the opposite direction of the current swing direction (at 604).

When the value of the actual acceleration is not more than a predetermined percentage less than the predicted acceleration (at 600), the controller 300 determines if a timer is running (at 606). If the timer is running and has reached a predetermined time period (e.g., approximately 100 milliseconds to approximately 2 seconds) (at 608), the controller 300 stops the timer (at 610) and resets the reference torque (at 612).

As illustrated in FIG. 10*b*, in Subroutine 1B, when the value of the actual acceleration is more than a predetermined percentage less than the predicted acceleration (at 620), the controller 300 increases the available torque limit (e.g., sets the torque up to approximately 200% of the current reference torque) and applies (e.g., 100%) the reference torque in the opposite direction of the current swing direction (at 622). Once the swing speed is reduced by a predetermined percentage (e.g., approximately 25% to approximately 50%) (at 624), the controller 300 returns swing control to its normal or default control method.

In Subroutine 1C (see FIG. 10*c*), when the value of the actual is more than a predetermined percentage less than the predicted acceleration (at 630), the controller 300 calculates an amount of torque to apply (i.e., calculates the magnitude of the deceleration force to apply to the dipper 140 swing) based on how large the difference is between the predicted acceleration and the actual acceleration (at 632). For example, as this difference increases, so does the torque applied. In some embodiments, the controller 300 also increases the maximum available swing torque before calculating the torque to apply. After calculating the torque, the controller 300 applies the calculated torque in the opposite direction of the current swing direction (at 634). When the swing speed is reduced by a predetermined percentage (e.g., approximately 25% to approximately 50%) (at 636), the controller 300 ends swing compensation control.

Figure 11A:
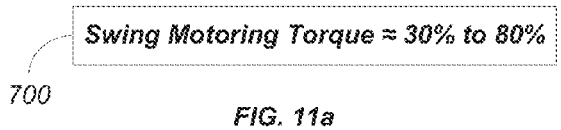
Figure 11B:
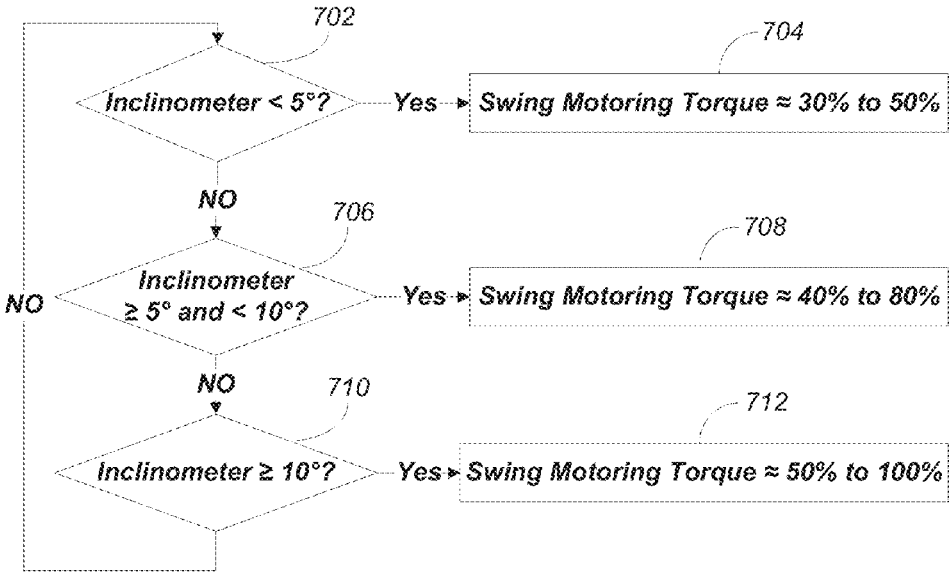
Figure 11C:
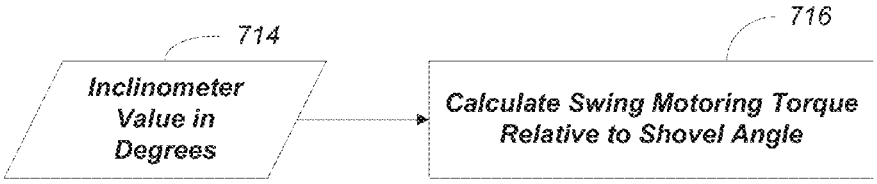
Figure 13:
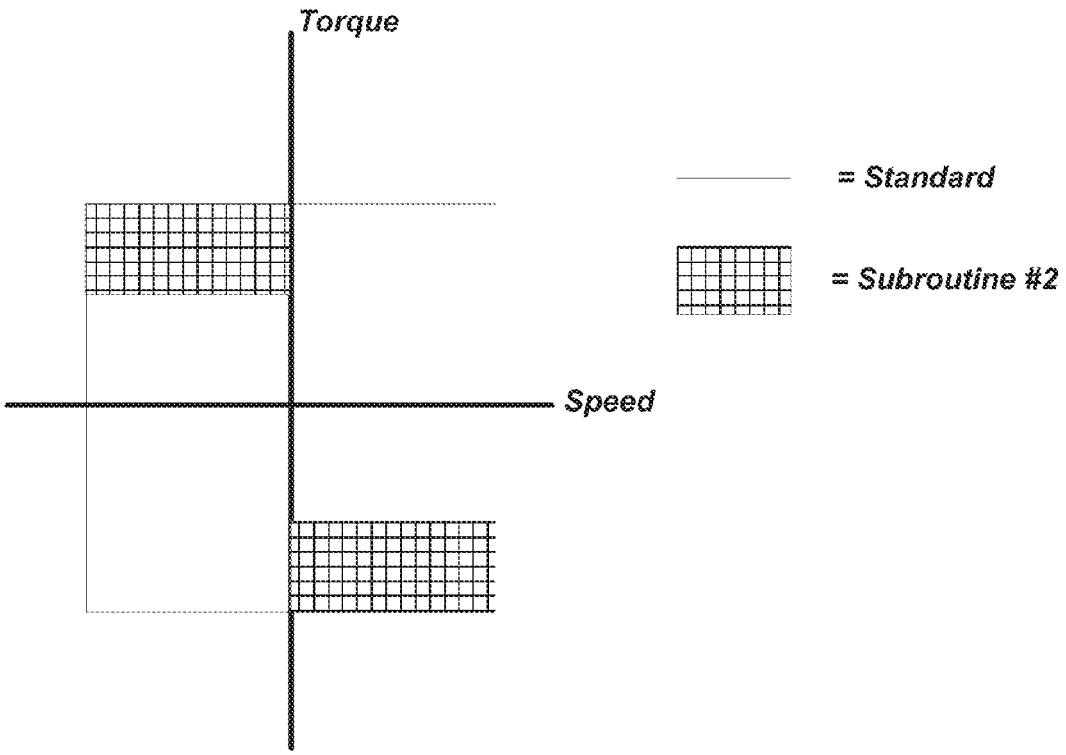

FIGS. 11*a*-11*c* illustrate Subroutine #2. Subroutine #2 provides three possible routines associated with calculating swing speed. The possible routines are defined as Subroutines 2A, 2B, and 2C. A representation of the resulting torque-speed curve for Subroutine #2 is shown in FIG. 13. As illustrated in FIG. 13, during execution of Subroutine #2, available torque is reduced.

As shown in FIG. 11*a*, in Subroutine 2A, the controller 300 sets the swing motoring torque to a predetermined percentage of available torque (e.g., approximately 30% to approximately 80% of available torque) (at 700). In Subroutine 2B (see FIG. 11*b*), the controller 300 monitors the shovel's inclinometer. If the shovel angle is less than a first predetermined angle (e.g., approximately 5°) (at 702), the controller 300 sets the swing motoring torque to a first predetermined percentage of available torque (e.g., approximately 30% to approximately 50%) (at 704). If the shovel angle is greater than or equal to the first predetermined angle and less than a second angle (e.g., approximately 10°) (at 706), the controller 300 sets the swing motoring torque to a second predetermined percentage of available torque (e.g., approximately 40% to approximately 80%) (at 708). If the shovel angle is greater than or equal to the second predetermined angle (at 710), the controller 300 sets the swing motoring torque to a third predetermined percentage of available torque (e.g., approximately 80% to approximately 100%) (at 712).

In Subroutine 2C, the controller 300 also monitors an inclinometer included in the shovel (at 714) and calculates the swing motoring torque limit level based on the shovel angle (at 716). In particular, the greater the angle of the shovel, the higher the torque limit level set by the controller 300.

Thus, embodiments of the invention relate to compensating dipper swing control to mitigate impacts between the dipper and a bank, the ground, a mobile crusher, a haul truck, etc. It should be understood that the numbering of the options and subroutines were provided for ease of description and are not intended to indicate importance or preference. Also, it should be understood that the controller 300 can perform additional functionality. In addition, the predetermined thresholds and values described in the present application may depend on the shovel 100, the environment where the shovel 100 is digging, and previous or current performance of the shovel 100. Therefore, any example values for these thresholds and values are provided as an example only and may vary.

Various features and advantages of the invention are set forth in the following claims.

What is claimed is:

1. A system for compensating swing of a dipper of a shovel, the system comprising:

a controller including at least one processor, the at least one processor configured to (a) limit a maximum available swing torque, (b) determine a crowd position of the dipper, and (c) restrict swing torque ramp up to the limited maximum available swing torque over a predetermined period of time after the dipper reaches a predetermined crowd position, (d) determine a direction of compensation opposite a current swing direction of the dipper, (e) increase the maximum available swing torque by a predetermined percentage, and (f) apply the maximum available swing torque in the direction of compensation opposite the current swing direction of the dipper when an acceleration of the dipper is greater than a predetermined acceleration value.

2. The system of claim 1, wherein the at least one processor is configured to limit the maximum available swing torque to approximately 30% to approximately 80% of the maximum available swing torque.

3. The system of claim 1, wherein the predetermined crowd position includes a predetermined percentage from a maximum crowd position.

4. The system of claim 3, wherein the predetermined percentage from the maximum crowd position is approximately 5% to approximately 30% from the maximum crowd position.

5. The system of claim 1, wherein the predetermined period of time is between approximately 100 milliseconds and 2 seconds.

6. The system of claim 1, wherein the at least one processor is configured to perform steps (a) through (c) when the shovel is in a dig state.

7. The system of claim 1, wherein the at least one processor is configured to perform steps (d) through (f) when the shovel is in a swing-to-dump state or a return-to-tuck state.

8. The system of claim 1, wherein the predetermined percentage is 200%.

9. The system of claim 1, wherein the at least one processor is further configured to stop applying the maximum available swing torque in the direction of compensation opposite the swing direction of the dipper when a swing speed of the dipper drops to or below a predetermined speed value.

10. The system of claim 9, wherein the predetermined speed value is between approximately 0 rpm and approximately 100 rpm.

11. The system of claim 1, wherein the predetermined acceleration value is based on a full state of the dipper.

12. The system of claim 1, wherein the predetermined acceleration value is based on an empty state of the dipper.

13. The system of claim 1, wherein the predetermined acceleration value is based on a current dipper load.

14. The system of claim 1, wherein the predetermined acceleration value is based on a current dipper position.

15. A system for compensating swing of a dipper of a shovel, the system comprising:

a controller including at least one processor, the at least one processor configured to (a) limit a maximum available swing torque, (b) determine a crowd position of the dipper, and (c) restrict swing torque ramp up to the limited maximum available swing torque over a predetermined period of time after the dipper reaches a predetermined crowd position, (d) determine a direction of compensation opposite a current swing direction of the dipper, and (e) apply the maximum available swing torque in the direction of compensation opposite the current swing direction of the dipper when an acceleration of the dipper is greater than a predetermined acceleration value and a swing speed of the dipper reaches a predetermined threshold.

16. The system of claim 15, wherein the predetermined threshold is approximately 5% to approximately 40% of a maximum speed.

* * * * *